US008638051B2

(12) United States Patent
Kwon

(10) Patent No.: US 8,638,051 B2
(45) Date of Patent: Jan. 28, 2014

(54) DC-DC CONVERTER AND DRIVING DEVICE OF LIGHT SOURCE FOR DISPLAY DEVICE USING THE SAME

(75) Inventor: Young Sup Kwon, Gwangmyeong-si (KR)

(73) Assignee: Samsung Display Co., Ltd., Yongin, Gyeonggi (KR)

( * ) Notice: Subject to any disclaimer, the term of this patent is extended or adjusted under 35 U.S.C. 154(b) by 341 days.

(21) Appl. No.: 13/216,419

(22) Filed: Aug. 24, 2011

(65) Prior Publication Data

US 2012/0256561 A1 Oct. 11, 2012

(30) Foreign Application Priority Data

Apr. 8, 2011 (KR) ..... 10-2011-0032589

(51) Int. Cl.
*H05B 37/00* (2006.01)

(52) U.S. Cl.
USPC ..... 315/307; 315/224; 315/308

(58) Field of Classification Search
USPC ..... 315/158, 276, 291, 307, 224, 308; 323/282, 234, 265
See application file for complete search history.

(56) References Cited

U.S. PATENT DOCUMENTS

| | | | | |
|---|---|---|---|---|
| 7,248,245 | B2 | 7/2007 | Adachi et al. | |
| 7,468,723 | B1 | 12/2008 | Collins | |
| 7,486,032 | B2 * | 2/2009 | Lee | 315/291 |
| 7,492,106 | B2 * | 2/2009 | Sengoku et al. | 315/276 |
| 7,667,414 | B2 | 2/2010 | Fujino et al. | |
| 7,728,798 | B2 | 6/2010 | Kim | |
| 2007/0200513 | A1 | 8/2007 | Ha et al. | |
| 2009/0066262 | A1 | 3/2009 | Tateishi et al. | |
| 2010/0213856 | A1 * | 8/2010 | Mizusako | 315/158 |

FOREIGN PATENT DOCUMENTS

| | | |
|---|---|---|
| JP | 2006-210435 | 8/2006 |
| JP | 2007-097251 | 4/2007 |
| JP | 4001856 | 8/2007 |
| JP | 2008-131839 | 6/2008 |
| JP | 2009-058857 | 3/2009 |
| KR | 1020070068804 | 7/2007 |
| KR | 1020090076330 | 7/2009 |
| KR | 1020090089527 | 8/2009 |
| KR | 100941145 | 2/2010 |

* cited by examiner

*Primary Examiner* — David H Vu
(74) *Attorney, Agent, or Firm* — F. Chau & Associates, LLC

(57) ABSTRACT

A DC-DC converter includes a plurality of boost circuits and a controller. The boost circuits are coupled to another in parallel. The boost circuits receive a DC voltage and boost the DC voltage. The controller drives the boost circuits with a duty ratio of less than 50% and different phases.

20 Claims, 6 Drawing Sheets

DC-DC CONVERTER AND DRIVING DEVICE OF LIGHT SOURCE FOR DISPLAY DEVICE USING THE SAME

CROSS-REFERENCE TO RELATED APPLICATION

This application claims priority to Korean Patent Application No. 10-2011-0032589 filed in the Korean Intellectual Property Office on Apr. 8, 2011, the disclosure of which is incorporated by reference herein.

BACKGROUND (a) Technical Field

Embodiments of the present inventive concept relate to a DC-DC converter, and a driving device of a light source for a display device using the same.

(b) Discussion of Related Art

A liquid crystal display (LCD) is a flat panel display (FPD), which is composed of two display panels on which field generating electrodes such as pixel electrodes and a common electrode are formed, and a liquid crystal layer interposed between the two display panels. Voltages are applied to the field generating electrodes to generate an electric field over the liquid crystal layer, and the alignment directions of liquid crystal molecules of the liquid crystal layer are adjusted by the electric field. The adjustment of the liquid crystal molecules changes the polarization of incident light, thereby enabling images to be displayed.

Since such a liquid crystal display is not self-emissive, a separate light source is required. The light source may be an artificial light source or a natural light source. The artificial light source used in the liquid crystal display may include a light emitting diode (LED), a cold cathode fluorescent lamp (CCFL), or an external electrode fluorescent (EEFL).

When using the fluorescent lamp, power consumption is large and element characteristics of the liquid crystal display may deteriorate due to heat. Further, the fluorescent lamp may be easily damaged by slight impacts. Moreover, since the temperature of a fluorescent lamp is not uniform, different sections of the lamp may have a varying luminance. Accordingly, the display quality of the liquid crystal display may deteriorate due to use of the fluorescent lamp.

The light emitting diode (LED) is a semiconductor element that has a long lifespan, a fast lighting speed, and low power consumption. Further, the LED can withstand certain impacts. Accordingly, there is a trend to include the light emitting diode (LED) in a backlight of a medium-sized or a large-sized liquid crystal display such as for a monitor or a television or in a backlight of a small-sized liquid crystal display such as for a portable phone.

The light emitting diode (LED) is driven by a DC voltage, as compared with the fluorescent lamp, which is driven by an AC voltage. When a light emitting diode (LED) is used as a backlight for a liquid crystal display, a DC-DC converter may be used to control the level of the DC voltage.

A boost type DC-DC converter may be used as the DC-DC converter. In the boost type, the duty ratio is increased to increase the current flowing to an output terminal. However, when the duty ratio is increased in this manner, the stress applied to components within the boost type DC-DC converter is increased, and heat is generated, which reduces the lifespan of the corresponding components. Further, a ripple of the current may be generated based on the increased duty ratio.

SUMMARY

At least one embodiment of the present invention may provide a DC-DC converter having an increased current flowing to an output terminal thereof without increasing a duty ratio and a driving device of a light source for a display device using the same.

At least one embodiment of the present invention may provide a DC-DC converter that reduces manufacturing costs since less stress is applied to parts thereof and reduces or prevents a ripple of a current therein, and a driving device of a light source for a display device using the same.

A DC-DC converter according to an exemplary embodiment of the present invention includes a plurality of boost circuits and a controller. The boost circuits are coupled in parallel with one another, receive a DC voltage, and boost the DC voltage. The controller drives the plurality of boost circuits with a duty ratio of less than 50% and different phases. A first one of the boost circuits and a second one of the second boost circuits may be driven with a phase difference of 180 degrees.

The DC-DC converter may include an input terminal receiving a DC voltage and an output terminal outputting a boosted DC voltage. The first boost circuit may include a first inductor connected to the input terminal, a first diode having one terminal connected to the output terminal and the other terminal connected to the first inductor, and a first switching element having an output terminal connected between the first inductor and the first diode. The second boost circuit may include a second inductor connected to the input terminal, a second diode including one terminal connected to the output terminal and the other terminal connected to the second inductor, and a second switching element having an output terminal connected between the second inductor and the second diode.

The control terminal of the first switching element may be applied with a first signal having a duty ratio of less than 50%, and the control terminal of the second switching element may be applied with a second signal having a duty ratio of less than 50%. A phase difference between the first and second signals may be 180 degrees.

The DC-DC converter may include an input terminal receiving a DC voltage and an output terminal outputting a boosted DC voltage. The first boost circuit may include a first inductor connected to the input terminal, a second inductor connected to the first inductor, a first diode coupled in series between the output terminal and the second inductor, and a first switching element having an output terminal connected between the first inductor and the second inductor. The second boost circuit may include a third inductor connected to the input terminal, a fourth inductor connected to the third inductor, a second diode coupled in series between the output terminal and the fourth inductor, and a second switching element having an output terminal connected between the third inductor and the fourth inductor.

The control terminal of the first switching element may be applied with a first signal having a duty ratio of less than 50%, and the control terminal of the second switching element may be applied with a second signal having a duty ratio of less than 50%. A phase difference between the first and second signals may be 180 degrees.

The DC-DC converter may include an input terminal receiving a DC voltage and an output terminal outputting a boosted DC voltage. The first boost circuit may include a first switching element having an input terminal connected to the input terminal, a first inductor having one terminal connected to the output terminal of the first switching element and the other terminal connected to the output terminal, and a first diode having one terminal between the output terminal of the first switching element and the first inductor. The second boost circuit may include a second switching element having an input terminal connected to the input terminal, a second inductor having one terminal connected to the output terminal of the second switching element and the other terminal connected to the output terminal, and a second diode having one terminal connected between the output terminal of the second switching element and the second inductor.

The control terminal of the first switching element may be applied with a first signal having a duty ratio of less than 50%, and the control terminal of the second switching element may be applied with a second signal having a duty ratio of less than 50%. A phase difference between the first and second signals may be 180 degrees.

A light source for a display device according to an exemplary embodiment of the invention includes a DC-DC converting unit, a light source unit, and a controller. The DC-DC converting unit includes a plurality of boost circuits coupled in parallel with one another. The boost circuits receive a DC voltage for boosting. The light source unit receives a power source from the DC-DC converting unit and provides light to the display device. The controller controls the plurality of boost circuits to have a duty ratio of less than 50% and different phases.

The controller may control a first one of the boost circuits and a second one of the boost circuits to have a phase difference of 180 degrees.

The DC-DC converter may include an input terminal receiving a DC voltage and an output terminal outputting a boosted DC voltage. The first boost circuit may include a first inductor connected to the input terminal, a first diode having one terminal connected to the output terminal and the other terminal connected to the first inductor, and a first switching element having an output terminal connected between the first inductor and the first diode. The second boost circuit may include a second inductor connected to the input terminal, a second diode including one terminal connected to the output terminal and the other terminal connected to the second inductor, and a second switching element having an output terminal connected between the second inductor and the second diode.

The control terminal of the first switching element may be applied with a first signal having a duty ratio of less than 50%, and the control terminal of the second switching element may be applied with a second signal having a duty ratio of less than 50%. A phase difference between the first and second signals may be 180 degrees.

The DC-DC converter may include an input terminal receiving a DC voltage and an output terminal outputting a boosted DC voltage. The first boost circuit may include a first inductor connected to the input terminal, a second inductor connected to the first inductor, a first diode coupled in series between the output terminal and the second inductor, and a first switching element having an output terminal connected between the first inductor and the second inductor. The second boost circuit may include a third inductor connected to the input terminal, a fourth inductor connected to the third inductor, a second diode coupled in series between the output terminal and the fourth inductor, and a second switching element having an output terminal connected between the third inductor and the fourth inductor.

The control terminal of the first switching element may be applied with a first signal having a duty ratio of less than 50%, and the control terminal of the second switching element may be applied with a second signal having a duty ratio of less than 50%. A phase difference between the first and second signals may be 180 degrees.

The DC-DC converter may include an input terminal receiving DC voltage and an output terminal outputting the boosted DC voltage. The first boost circuit may include a first switching element having an input terminal connected to the input terminal, a first inductor having one terminal connected to the output terminal of the first switching element and the other terminal connected to the output terminal, and a first diode having one terminal between the output terminal of the first switching element and the first inductor. The second boost circuit may include a second switching element having an input terminal connected to the input terminal, a second inductor having one terminal connected to the output terminal of the second switching element and the other terminal connected to the output terminal, and a second diode having one terminal connected between the output terminal of the second switching element and the second inductor.

The control terminal of the first switching element may be applied with a first signal having a duty ratio of less than 50%, and the control terminal of the second switching element may be applied with a second signal having a duty ratio of less than 50%. A phase difference between the first and second signals may be 180 degrees.

According to an exemplary embodiment of the present invention, a driving device for a light source of a display device includes a plurality of voltage converters and a controller. The voltage converters are connected in parallel with one another. The voltage converters are one of boost converters, flyback converters, buck converters, forward converter, or buck-boost converters. The controller is configured to drive each voltage converter with a duty ratio of less than 50% and with different phases. An output of the voltage converters provides a power source to the light source. A first one of the voltage converters and a second one of the voltage converters may be driven with a phase difference of 180 degrees. The controller may apply a signal having a duty ratio of less than 50% to a control terminal of a switching element of each voltage converter. The controller may also control the light source.

DETAILED DESCRIPTION

Figure 1:
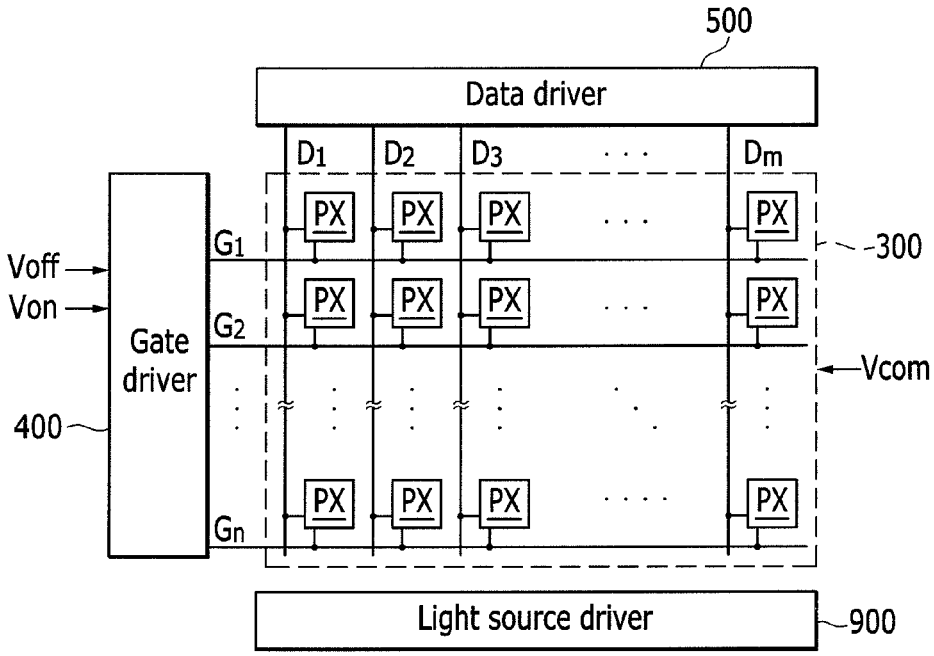
FIG. 1 is a block diagram of a display device according to an exemplary embodiment of the present invention.

The present invention will be described more fully hereinafter with reference to the accompanying drawings, in which exemplary embodiments of the invention are shown. However, the described embodiments may be modified in various different ways, without departing from the spirit or scope of the disclosure.

In the drawings, the thickness of layers, films, panels, regions, etc., may be exaggerated for clarity. Like reference numerals designate like elements throughout the specification. It will be understood that when an element such as a layer, film, region, or substrate is referred to as being "on" another element, it can be directly on the other element or intervening elements may also be present.

FIG. 1 is a block diagram of a display device according to an exemplary embodiment of the present invention. The display device may be one of various flat panel displays, which use a light source, such as a liquid crystal display. Further, the display device may be a 3D stereoscopic image display device or an image display device that can switch between a 2D mode and a 3D mode.

Referring to FIG. 1, the display device includes a display panel assembly 300, a gate driver 400, a data driver 500, and a light source driver 900.

In an equivalent circuit, the display panel assembly 300 includes a plurality of gate lines G1-Gn, a plurality of data lines D1-Dm, and a plurality of pixels PX that are connected to the signal lines. The pixels may be arranged in a matrix or approximately a matrix.

The gate lines G1-Gn transmit gate voltages (referred to as "gate signals" or "scanning signals") and the data lines D1-Dm transmit data voltages.

Each pixel PX, for example, the pixel PX connected to the i-th (i=1, 2, . . . , n) gate line Gi and the j-th (j=1, 2, . . . , m) data line Dj includes a switching element (not shown) electrically connected to the gate line Gi and the data line Dj.

The data driver 500 is connected to the data lines D1-Dm of the display panel assembly 300, and applies the data voltages to the data lines D1-Dm.

The gate driver 400 is connected to the gate lines G1 to Gn of the display panel assembly 300, and applies the gate signals to the gate lines G1 to Gn. A gate signal may be generated by combining a gate-on voltage Von for turning on the switching element and a gate-off voltage Voff for turning off the switching element.

Figure 2:
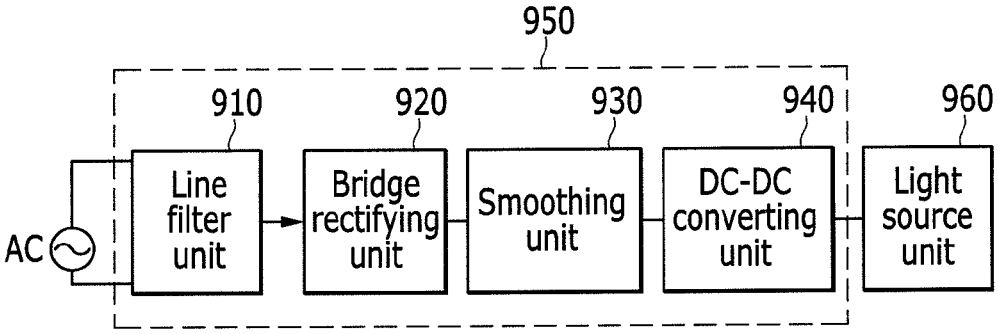
FIG. 2 is a block diagram of a light source driver of a display device according to an exemplary embodiment of the present invention.

FIG. 2 is a block diagram of a light source driver of a display device according to an exemplary embodiment of the present invention.

The light source driver 900 includes a light source unit 960 and a power source supplying unit 950 supplying a power source voltage to the light source unit 960. The light source 960 may be mounted under the display panel assembly 300.

The light source unit 960 includes a plurality of light emitting diodes (LED). The light emitting diodes may include a plurality of red, green, and blue light emitting diodes (LED), which may be alternately arranged. For example, a color display can be created by having each pixel uniquely display one of three primary colors (e.g., known as spatial division) or to alternately display the three primary colors as time passes (e.g., known as temporal division). The three primary colors may then be spatially or temporally synthesized to obtain a desired color.

The power source supplying unit 950 includes a line filter unit 910, a bridge rectifying unit 920 connected to the line filter unit 910, a smoothing unit 930 connected to the bridge rectifying unit 920, and a DC-DC converting unit 940 connected to the smoothing unit 930. An AC voltage is applied to the line filter unit 910.

The line filter unit 910 may remove a noise component from the AC voltage AC and apply the resulting AC voltage to the bridge rectifying unit 920. The line filter unit 910 may include a primary coil (not shown) and a secondary coil (not shown). A turn ratio of the primary coil (not shown) with respect to the secondary coil (not shown) may be 1, which may prevent losses to an output voltage of the power source supplying unit 950.

The bridge rectifying unit 920 may perform a full-wave rectification of the AC voltage from the line filter unit 910 and applies the rectified signal to the smoothing unit 930.

The smoothing unit 930 smoothes an AC voltage that is converted into DC through the full-wave rectification to apply a DC component having a uniform voltage to the DC-DC converting unit 940.

The DC-DC converting unit 940 boosts a DC voltage input from the smoothing unit 930 to a voltage level required for operation of the light source unit 960 and applies the boosted voltage to the light source unit 960.

Figure 3:
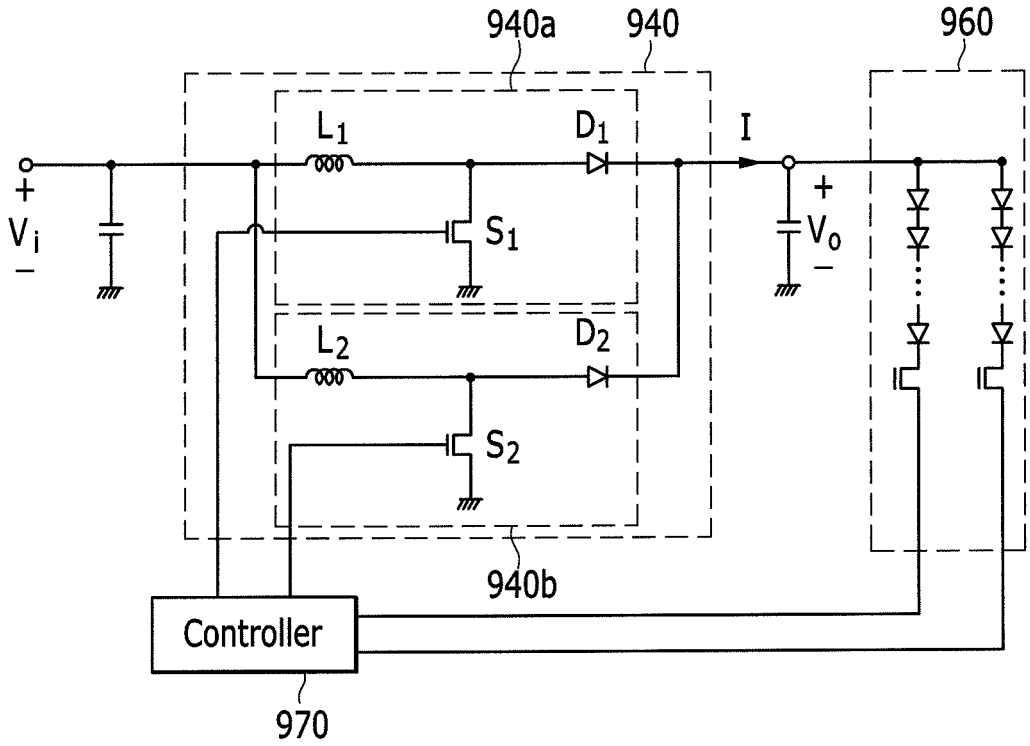
FIG. 3 is a circuit diagram of a driving device of a light source according to an exemplary embodiment of the present invention.
Figure 4:
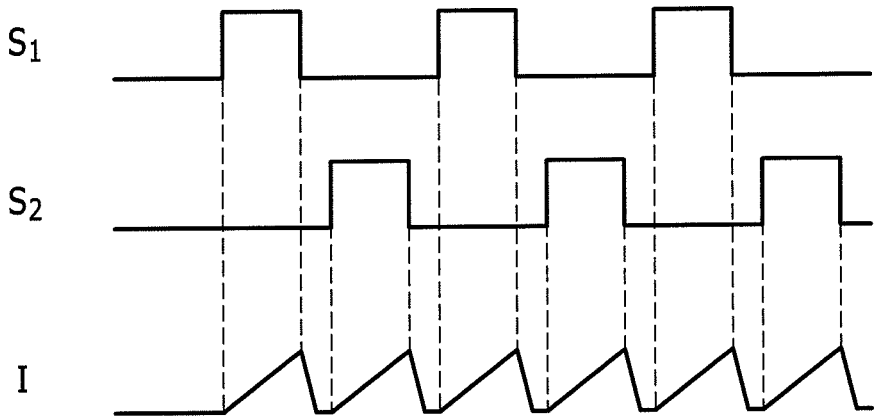
FIG. 4 shows an exemplary signal waveform diagram of a driving device of a light source according to an exemplary embodiment of the present invention.

FIG. 3 is a circuit diagram of a driving device of a light source according to an exemplary embodiment of the present invention, and FIG. 4 is an exemplary signal waveform diagram of a driving device of a light source according to an exemplary embodiment of the present invention.

The driving device of the light source includes the DC-DC converting unit 940, the light source unit 960, and a controller 970. The DC-DC converting unit 940 boosts the DC voltage and outputs the boosted voltage. The light source unit 960 receives a power source from the DC-DC converting unit 940 to provide irradiating light to the display device. The controller 970 controls the DC-DC converting unit 940 and the light source unit 960.

The DC-DC converting unit 940 includes a first boost circuit 940*a* and a second boost circuit 940*b*. For example, the first boost circuit 940*a* is coupled to the second boost circuit 940*b* in parallel. Each boost circuit 940*a* and 940*b* may be a boost converter. A boost converter is a power converter with an output DC voltage greater than its input voltage. The first boost circuit 940*a* and the second boost circuit 940*b* each include one inductor, one diode, and one switching element. The inductor, diode, and switching element may be connected in a "T" shape. The input terminal of the DC-DC converting unit 940 is applied with the DC voltage, and the boosted DC voltage is output to the output terminal. The output terminal of the DC-DC converting unit 940 is connected to the light source unit 960.

The first boost circuit 940*a* includes a first inductor $L_1$ connected to the input terminal of the DC-DC converting unit 940, a first diode $D_1$ including one terminal connected to the output terminal of the DC-DC converting unit 940 and the other terminal connected to the first inductor $L_1$, and a first switching element $S_1$ including an output terminal connected between the first inductor $L_1$ and the first diode $D_1$.

The control terminal (e.g., gate) of the first switching element $S_1$ is connected to the controller 970 to receive a signal from the controller 970 to be switched, and an input terminal of the first switching element $S_1$ is grounded.

The second boost circuit 940*b* includes a second inductor $L_2$ connected to the input terminal of the DC-DC converting unit 940, a second diode $D_2$ including one terminal connected to the output terminal of the DC-DC converting unit 940 and the other terminal connected to the second inductor $L_2$, and a second switching element $S_2$ including an output terminal connected between the second inductor $L_2$ and the second diode $D_2$.

The control terminal of the second switching element $S_2$ is connected to the controller 970 to receive a signal from the controller 970 to be switched, and the input terminal of the second switching element $S_2$ is grounded.

The light source unit 960 includes a plurality of light emitting diodes LED that are coupled in series in two columns, and the light emitting diodes LED of the two columns are coupled in parallel. For example, the light source unit 960 includes LEDs having series and parallel connections. However, embodiments of the present invention are not limited thereto. For example, a plurality of light emitting diodes LED may be connected only in series or only in parallel. Further, the series and parallel connections of the LEDs may have a different arrangement from that shown in FIG. 3.

The controller 970 may control the first boost circuit 940*a* and the second boost circuit 940*b* such that they have a duty ratio of less than 50% and are driven with different phases. For example, the controller 970 may control the first boost circuit 940*a* and the second boost circuit 940*b* to have a phase difference of 180 degrees.

Referring to the signal waveform shown in FIG. 4, the controller 970 applies a first signal having a duty ratio of less than 50% to the control terminal of the first switching element $S_1$. Further, the controller 970 applies a second signal having a duty ratio of less than 50% and a phase difference of 180 degrees with respect to the first signal to the control terminal of the second switching element $S_2$. The first signal and the second signal have a duty ratio of less than 50% such that a period in which the first switching element $S_1$ and the second switching element $S_2$ are in an on state is shorter than a period in which the first switching element $S_1$ and the second switching element $S_2$ are in an off state. The first signal and the second signal are repeatedly input several times to the control terminal of the first switching element $S_1$ and the second switching element $S_2$ during one displayed frame of the display panel 300.

The current I flowing to the output terminal of the DC-DC converting unit 940 is the sum of the currents flowing to each output terminal of the first boost circuit 940*a* and the second boost circuit 940*b*. Accordingly, by coupling two boost circuits in parallel, the current I flowing to the output terminal of the DC-DC converting unit 940 during one frame is larger than that of one boost circuit. In this way, the current flowing to the output terminal may be increased without increasing the duty ratio.

The first boost circuit 940*a* and the second boost circuit 940*b* are driven with the lesser duty ratio such that the current I flowing to the output terminal of the DC-DC converting unit 940 is discontinuous. For example, a discontinuous current mode (DCM) is realized.

Figure 5:
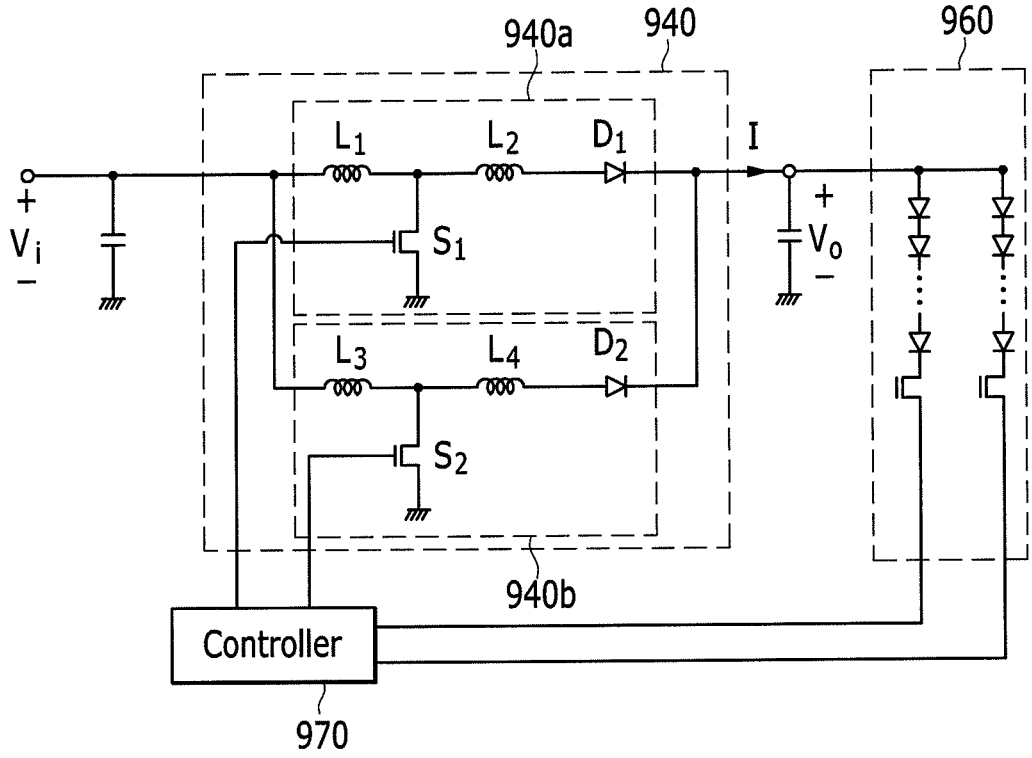
FIG. 5 is a circuit diagram of a driving device of a light source according to an exemplary embodiment of the present invention.

FIG. 5 is a circuit diagram of a driving device of a light source according to an exemplary embodiment of the present invention. The driving device of FIG. 5 includes a DC-DC converting unit 940, a light source unit 960, and a controller 970. The DC-DC converting unit 940 boosts the DC voltage and outputs the boosted voltage. The light source unit 960 receives the power source from the DC-DC converting unit 940 to provide irradiating light to the display device. The controller 970 controls the DC-DC converting unit 940 and the light source unit 960.

The DC-DC converting unit 940 includes the first boost circuit 940*a* and the second boost circuit 940*b*. For example, the first boost circuit 940*a* is coupled in parallel to the second boost circuit 940*b*. Each boost circuit 940*a* and 940*b* may be a flyback converter. A flyback converter may be a buck-boost converter with an inductor split to form a transformer. The first boost circuit 940*a* and the second boost circuit 940*b* each include two inductors, one diode, and one switching element. The two inductors, one diode, and one switching element may be connected in a "T" shape. A DC voltage is applied to the input terminal of the DC-DC converting unit 940, and the output terminal outputs the boosted DC voltage. The output terminal of the DC-DC converting unit 940 is connected to the light source unit 960.

The first boost circuit 940*a* includes a first inductor $L_1$ connected to the input terminal of the DC-DC converting unit 940, a second inductor $L_2$ connected to the first inductor $L_1$, a first diode $D_1$ coupled in series between the output terminal of the DC-DC converting unit 940 and the second inductor $L_2$, and a first switching element $S_1$ having an output terminal connected between the first inductor $L_1$ and the second inductor $L_2$.

The control terminal of the first switching element $S_1$ is connected to the controller 970 to receive the signal from the controller 970 to be switched, and the input terminal of the first switching element $S_1$ is grounded.

The second boost circuit 940*b* includes a third inductor $L_3$ connected to the input terminal of the DC-DC converting unit 940, a fourth inductor $L_4$ connected to the third inductor $L_3$, a second diode $D_2$ coupled in series between the output terminal of the DC-DC converting unit 940 and the fourth inductor $L_4$, and a second switching element $S_2$ including an output terminal connected between the third inductor $L_3$ and the fourth inductor $L_4$.

The control terminal of the second switching element $S_2$ is connected to the controller 970 to receive the signal from the controller 970 to be switched, and the input terminal of the second switching element $S_2$ is grounded.

The light source unit 960 includes a plurality of light emitting diodes LED that are coupled in series in two columns, and the light emitting diodes LED of the two columns are coupled in parallel. For example, the LEDs include series and parallel connections. However, embodiments of the present invention are not limited thereto. For example, a plurality of light emitting diodes LED may be connected only in series or in parallel. Further, the series and parallel connections of the LEDs may be arranged in a manner different from that shown in FIG. 5.

The controller 970 controls the first boost circuit 940*a* and the second boost circuit 940*b* to have a duty ratio of less than 50% and to be driven with different phases. For example, the controller 970 may control the first boost circuit 940*a* and the second boost circuit 940*b* to have a phase difference of 180 degrees.

With respect to the driving device of FIG. 5, the waveform of the signal applied to the first switching element $S_1$ and the second switching element $S_2$ by the controller 970 and the current I flowing to the output terminal of the DC-DC converting unit 940 are the same as those of the driving device of FIG. 3.

Figure 6:
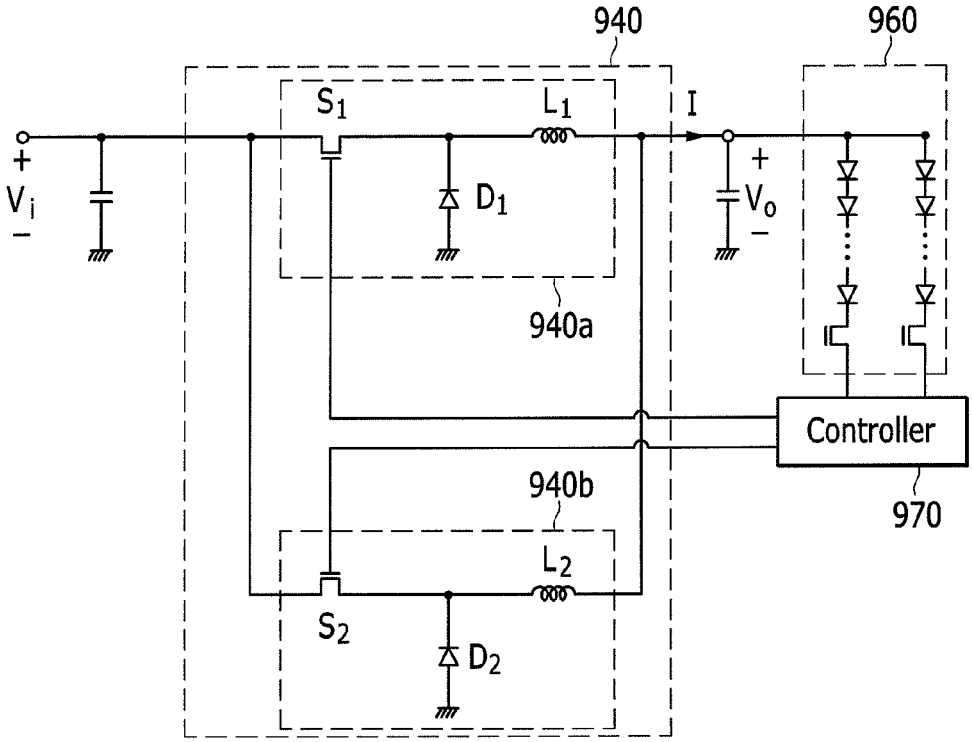
FIG. 6 is a circuit diagram of a driving device of a light source according to an exemplary embodiment of the present invention.

FIG. 6 is a circuit diagram of a driving device of a light source according to an exemplary embodiment of the present invention. The driving device of FIG. 6 includes a DC-DC converting unit 940, a light source unit 960, and a controller 970. The DC-DC converting unit 940 boosts the DC voltage and outputs the boosted voltage. The light source unit 960 receives the power source from the DC-DC converting unit 940 to provide irradiating light to the display device. The controller 970 controls the DC-DC converting unit 940 and the light source unit 960.

The DC-DC converting unit 940 includes a first boost circuit 940*a* and a second boost circuit 940*b*. For example, the first boost circuit 940*a* and second boost circuit 940*b* are coupled in parallel to one another. The boost circuits 940*a* and 940*b* may be buck type converters. A buck converter may be a step down DC-DC converter. The first boost circuit 940*a* and the second boost circuit 940*b* include one switching element, one inductor, and one diode. The switching element, inductor, and diode may be connected in a "T" shape. A DC voltage is applied to the input terminal of the DC-DC converting unit 940, and the boosted DC voltage is output to the output terminal. The output terminal of the DC-DC converting unit 940 is connected to the light source unit 960.

The first boost circuit 940*a* includes a first switching element $S_1$ having an input terminal connected to the input terminal of the DC-DC converting unit 940, a first inductor $L_1$ having one terminal connected to an output terminal of the first switching element $S_1$ and the other terminal connected to the output terminal thereof, and a first diode $D_1$ having one terminal connected between the output terminal of the first switching element $S_1$ and the first inductor $L_1$.

The control terminal of the first switching element $S_1$ is connected to the controller 970 to receive a signal from the controller 970 to be switched, and the other terminal of the first diode $D_1$ is grounded.

The second boost circuit 940*b* includes a second switching element $S_2$ having an input terminal connected to the input terminal of the DC-DC converting unit 940, a second inductor $L_2$ having one terminal connected to an output terminal of the second switching element $S_2$ and the other terminal connected to the output terminal thereof, and a second diode $D_2$ having one terminal connected between the output terminal of the second switching element $S_2$ and the second inductor $L_2$.

The control terminal of the second switching element $S_2$ is connected to the controller 970 to receive a signal from the controller 970 to be switched, and the other terminal of the second diode $D_2$ is grounded.

The light source unit 960 includes a plurality of light emitting diodes LED that are coupled in series in two columns, and the light emitting diodes LED of two columns are coupled in parallel. For example, the LEDs include series and parallel connections. However, embodiments of the present invention are not limited thereto. For example, a plurality of light emitting diodes LED may only be connected in series or in parallel. Further, the series and parallel connections of the LEDs may be arranged in manner different from that shown in FIG. 3.

The controller 970 controls the first boost circuit 940*a* and the second boost circuit 940*b* to have a duty ratio of less than 50% and to be driven with different phases. For example, the controller 970 may control the first boost circuit 940*a* and the second boost circuit 940*b* to have a phase difference of 180 degrees.

The waveform of the signal applied to the first switching element $S_1$ and the second switching element $S_2$ by the controller 970 and the current I flowing to the output terminal of the DC-DC converting unit 940 are the same as those of the exemplary embodiment shown in FIG. 3.

While at least one of the above exemplary embodiments includes two boost circuits coupled in parallel with one another to form a DC-DC converting unit, the present invention is not limited thereto. For example, in an alternate embodiment of the invention, at least three boost circuits may be coupled in parallel to form the DC-DC converting unit. For example, when coupling three boost circuits in parallel to form the DC-DC converting unit, the boost circuits may have a duty ratio of less than 33% and a phase difference of 120 degrees.

In FIG. 3, FIG. 5, and FIG. 6, the boost converter, the flyback converter, and the buck converter are respectively used as the boost circuits to couple a plurality of boost circuits in parallel for the DC-DC converting unit. However, embodiments of the present invention are not limited thereto. For example, a different circuit may be used as the boost circuit instead of the boost converter, the flyback converter, and the buck converter. For example, buck-boost converters or forward converters may be coupled in parallel to form the DC-DC converting unit. A buck-boost converter is a type of DC-DC converter that has an output voltage magnitude that is either greater than or less than the input voltage magnitude. A forward converter is a DC-DC converter that uses transfer windings to buck or boost the voltage depending on the transformer ratio.

While the invention has been described in connection with exemplary embodiments thereof, it is to be understood that the invention is not limited to the disclosed embodiments, but is intended to cover various modifications and equivalent arrangements included within the spirit and scope of the disclosure.

What is claimed is:

1. A DC-DC converter comprising:

a plurality of boost circuits coupled in parallel with one another, receiving a DC voltage, and boosting the DC voltage; and a controller configured to drive each boost circuit with a duty ratio of less than 50% and with different phases.

2. The DC-DC converter of claim 1, wherein a first one of the boost circuits and a second one of the boost circuits are driven with a phase difference of 180 degrees.

3. The DC-DC converter of claim 2, wherein the DC-DC converter includes an input terminal receiving a DC voltage and an output terminal outputting a boosted DC voltage, and the first boost circuit includes:

a first inductor connected to the input terminal;

a first diode having one terminal connected to the output terminal and the other terminal connected to the first inductor; and a first switching element having an output terminal connected between the first inductor and the first diode, and the second boost circuit includes:

a second inductor connected to the input terminal;

a second diode including one terminal connected to the output terminal and the other terminal connected to the second inductor; and a second switching element having an output terminal connected between the second inductor and the second diode.

4. The DC-DC converter of claim 3, wherein a first signal having a duty ratio of less than 50% is applied to a control terminal of the first switching element, a second signal having a duty ratio of less than 50% is applied to a control terminal of the second switching element, and a phase difference between the first and second signals is 180 degrees.

5. The DC-DC converter of claim 2, wherein the DC-DC converter includes an input terminal receiving a DC voltage and an output terminal outputting a boosted DC voltage, and the first boost circuit includes:

a first inductor connected to the input terminal;

a second inductor connected to the first inductor;

a first diode coupled in series between the output terminal and the second inductor; and a first switching element having an output terminal connected between the first inductor and the second inductor, and the second boost circuit includes:

a third inductor connected to the input terminal;

a fourth inductor connected to the third inductor;

a second diode coupled in series between the output terminal and the fourth inductor; and a second switching element having an output terminal connected between the third inductor and the fourth inductor.

6. The DC-DC converter of claim 5, wherein a first signal having a duty ratio of less than 50% is applied to a control terminal of the first switching element, a second signal having a duty ratio of less than 50% is applied to a control terminal of the second switching element, and a phase difference between the first and second signals is 180 degrees.

7. The DC-DC converter of claim 2, wherein the DC-DC converter includes an input terminal receiving a DC voltage and an output terminal outputting the boosted DC voltage, and the first boost circuit includes:

a first switching element having an input terminal connected to the input terminal;

a first inductor having one terminal connected to the output terminal of the first switching element and the other terminal connected to the output terminal; and a first diode having one terminal between the output terminal of the first switching element and the first inductor, and the second boost circuit includes:

a second switching element having an input terminal connected to the input terminal;

a second inductor having one terminal connected to the output terminal of the second switching element and the other terminal connected to the output terminal; and a second diode having one terminal connected between the output terminal of the second switching element and the second inductor.

8. The DC-DC converter of claim 7, wherein a first signal having a duty ratio of less than 50% is applied to a control terminal of the first switching element, a second signal having a duty ratio of less than 50% is applied to a control terminal of the second switching element, and a phase difference between the first and second signals is 180 degrees.

9. A light source for a display device, comprising:

a DC-DC converting unit including a plurality of boost circuits coupled in parallel with one another and receiving a DC voltage for boosting;

a light source unit receiving a power source from the DC-DC converting unit and providing light to the display device; and a controller controlling the boost circuits to have a duty ratio of less than 50% and different phases.

10. The light source of claim 9, wherein the controller controls a first one of the boost circuits and a second one of the boost circuits to have a phase difference of 180 degrees.

11. The light source of claim 10, wherein the DC-DC converter includes an input terminal receiving a DC voltage and an output terminal outputting a boosted DC voltage, and the first boost circuit includes:

a first inductor connected to the input terminal;

a first diode having one terminal connected to the output terminal and the other terminal connected to the first inductor; and a first switching element having an output terminal connected between the first inductor and the first diode, and the second boost circuit includes:

a second inductor connected to the input terminal;

a second diode including one terminal connected to the output terminal and the other terminal connected to the second inductor; and a second switching element having an output terminal connected between the second inductor and the second diode.

12. The light source of claim 11, wherein a first signal having a duty ratio of less than 50% is applied to a control terminal of the first switching element, a second signal having a duty of less than 50% is applied to a control terminal of the second switching element, and a phase difference between the first and second signals is 180 degrees.

13. The light source of claim 10, wherein the DC-DC converter includes an input terminal receiving a DC voltage and an output terminal outputting a boosted DC voltage, and the first boost circuit includes:

a first inductor connected to the input terminal;

a second inductor connected to the first inductor;

a first diode coupled in series between the output terminal and the second inductor; and a first switching element having an output terminal connected between the first inductor and the second inductor, and the second boost circuit includes:

a third inductor connected to the input terminal;

a fourth inductor connected to the third inductor;

a second diode coupled in series between the output terminal and the fourth inductor; and a second switching element having an output terminal connected between the third inductor and the fourth inductor.

14. The light source of claim 13, wherein:

a first signal with a duty ratio of less than 50% is applied to a control terminal of the first switching element, a second signal with a duty ratio of less than 50% is applied to a control terminal of the second switching element, and a phase difference between the first and second signals is 180 degrees.

15. The light source of claim 10, wherein the DC-DC converter includes an input terminal receiving a DC voltage and an output terminal outputting a boosted DC voltage, and the first boost circuit includes:

a first switching element having an input terminal connected to the input terminal;

a first inductor having one terminal connected to the output terminal of the first switching element and the other terminal connected to the output terminal; and a first diode having one terminal between the output terminal of the first switching element and the first inductor, and the second boost circuit includes:

a second switching element having an input terminal connected to the input terminal;

a second inductor having one terminal connected to the output terminal of the second switching element and the other terminal connected to the output terminal; and a second diode having one terminal connected between the output terminal of the second switching element and the second inductor.

16. The light source of claim 15, wherein a first signal having a duty ratio of less than 50% is applied to a control terminal of the first switching element, a second signal having a duty ratio of less than 50% is applied to a control terminal of the second switching element, and a phase difference between the first and second signals is 180 degrees.

17. A driving device for a light source of a display device, comprising:

a plurality of voltage converters connected in parallel with one another, wherein the voltage converters are one of boost converters, flyback converters, buck converters, forward converter, or buck-boost converters; and a controller configured to drive each voltage converter with a duty ratio of less than 50% and with different phases, wherein an output of the voltage converters provides a power source to the light source.

18. The driving device of claim 17, wherein a first one of the voltage converters and a second one of the voltage converters are driven with a phase difference of 180 degrees.

19. The driving device of 18, wherein the controller applies a signal having a duty ratio of less than 50% to a control terminal of a switching element of each voltage converter.

20. The driving device of claim 17, wherein the controller also controls the light source.

* * * * *